US009466901B2

(12) United States Patent
Ikenaka

(10) Patent No.: US 9,466,901 B2
(45) Date of Patent: Oct. 11, 2016

(54) LOW INSERTION FORCE PLUG CONNECTOR WITH SLIDING MEMBER

(71) Applicant: ITT MANUFACTURING ENTERPRISES, LLC, Wilmington, DE (US)

(72) Inventor: Kazuo Ikenaka, Zama (JP)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 14/811,145

(22) Filed: Jul. 28, 2015

(65) Prior Publication Data

US 2016/0043490 A1 Feb. 11, 2016

(30) Foreign Application Priority Data

Aug. 6, 2014 (JP) ..... 2014-160768

(51) Int. Cl.
*H01R 11/22* (2006.01)
*H01R 12/72* (2011.01)
*H01R 12/89* (2011.01)

(52) U.S. Cl.
CPC ..... *H01R 12/721* (2013.01); *H01R 12/89* (2013.01)

(58) Field of Classification Search
CPC ..... H01R 13/193; H01R 23/684; H01R 23/6833; H05K 7/1023
USPC ..... 439/259, 260, 266, 267
See application file for complete search history.

(56) References Cited

U.S. PATENT DOCUMENTS 4,196,955 A * 4/1980 Anhalt ..... H01R 12/89 439/267
4,257,660 A * 3/1981 Chalmers ..... H01R 12/88 439/267
4,695,111 A * 9/1987 Grabbe ..... H01R 12/88 439/260
5,096,435 A 3/1992 Noschese
6,527,572 B2 3/2003 Jou (Continued)

FOREIGN PATENT DOCUMENTS

JP 2001203484 7/2001
JP 2002170645 6/2002

(Continued)

OTHER PUBLICATIONS

Japanese Office Action for Japanese Application No. 2014-160768 mailed Jun. 30, 2015, including English translation.

(Continued)

*Primary Examiner* — Thanh Tam Le
(74) *Attorney, Agent, or Firm* — RatnerPrestia

(57) ABSTRACT

A plug connector includes a substrate, an insulator, a slider, and a contactor. The slider is slidable between first and second positions inside the insulator. The contactor is housed between an inner surface of a housing space part of the slider and a substrate receiver part. The substrate receiver part fixes the lead contact part of the contactor to a position apart from an electrode pad of the substrate in a state where the slider is located at the first position or fixes to a position where a pressing force of the lead contact part against the electrode pad is limited to not greater than a predetermined value, and releases fixation of the position when the slider is moved from the first position to the second position. The slider presses the lead contact part against the electrode pad by pressing the contactor when sliding.

8 Claims, 6 Drawing Sheets

(56) References Cited

U.S. PATENT DOCUMENTS

| | | | | |
|---|---|---|---|---|
| 6,997,728 | B1 * | 2/2006 | Chen | H01R 12/87 439/260 |
| 7,014,487 | B2 * | 3/2006 | Ishikawa | H01R 13/055 439/267 |
| 7,077,675 | B2 * | 7/2006 | Maeda | H01R 13/193 439/260 |
| 7,140,909 | B2 * | 11/2006 | Moritake | H01R 12/89 439/260 |
| 7,338,303 | B1 * | 3/2008 | Yi | H01R 12/87 439/267 |
| 7,390,208 | B1 * | 6/2008 | Sabo | H01R 12/57 439/260 |
| 7,527,513 | B1 | 5/2009 | Okuyama | |
| 8,616,907 | B2 * | 12/2013 | Kim | H01R 12/87 439/160 |
| 8,905,773 | B2 * | 12/2014 | Liang | H01R 12/87 439/260 |
| 2006/0009063 | A1 | 1/2006 | Ishikawa | |

FOREIGN PATENT DOCUMENTS

| | | |
|---|---|---|
| JP | 2005056745 | 3/2005 |
| JP | 2006024454 | 1/2006 |
| JP | 2014086187 | 5/2014 |

OTHER PUBLICATIONS

Japanese Office Action for Japanese Application No. 2014-160768 mailed Oct. 20, 2015, including English translation.

Collette, et al., "Twin-Contact Connector", IBM Technical Disclosure Bulletin, vol. 12, No. 9, Feb. 9, 1972.

Extended European Search Report dated Dec. 7, 2015 for EP Application No. 15177989.9.

* cited by examiner

LOW INSERTION FORCE PLUG CONNECTOR WITH SLIDING MEMBER

CROSS-REFERENCE TO RELATED APPLICATIONS

This application claims priority to Japanese Patent Application No. 2014-160768, filed Aug. 6, 2014, the content of such application being incorporated by reference herein in its entirety.

TECHNICAL FIELD

The present invention relates to, for example, a plug connector comprising a plurality of contactors.

BACKGROUND ART

For example, a plug connector of a multi-poled zero insertion force (ZIF) connector type has an insulator to which a plurality of contactors is fixed, and a substrate housed inside the insulator. The substrate has an electrode pad electrically connected to the contactor. A lead contact part of the contactor and the electrode pad of the substrate are soldered to each other, whereby electrical connection is fixed. By fixing the lead contact part of the contactor and the electrode pad of the substrate by soldering, sufficient connection strength between the lead contact part of the contactor and the electrode pad of the substrate can be obtained.

Soldering work between the lead contact part of the contactor and the electrode pad of the substrate is generally performed by hand using soldering iron (for example, see Patent Documents 1, 2).

PRIOR ART DOCUMENTS

Patent Documents

Patent Document 1: Japanese Unexamined Patent Application Publication No. 2002-170645

Patent Document 2: Japanese Unexamined Patent Application Publication No. 2014-086187

SUMMARY OF THE INVENTION

Problems to be Solved by the Invention

In a structure in which electrical connection between the lead contact part of the contactor and the electrode pad of the substrates is fixed by soldering described above, there were the following problems. Since the lead contact part of the contactor and the electrode pad of the substrate are fixed via soldering by hand, the work takes much time. In particular, when a multi-poled type plug connector having a plurality of contactors is used, the work takes more time.

On the other hand, if a plug connector is a multi-poled type having a plurality of contactors, a pitch between the contactors becomes narrow. For this reason, a bridge may occur in which the lead contact parts of the contactors adjacent to each other are electrically connected via soldering. Alternatively, flux liquid used for soldering work interferes with joints of the lead contact part of the contactor and the electrode pad of the substrate, and consequently, malfunctions may be caused in the electrical connection between the lead contact part and the electrode pad. On the other hand, it is difficult to remove the substrate on which soldering has been performed from the contactor. Accordingly, when the above-described bridge or malfunction occurs, the plug connector is discarded, thus the yield becomes worse.

Therefore, the object of the present invention is to provide a plug connector capable of improving the efficiency of attaching work of the substrates, and improving the yield.

Means to Solve the Problem

A plug connector of the present invention comprises a substrate provided with an electrode pad, an insulator provided therein with a first housing space part, a contactor comprising a lead contact part connectable to the electrode pad of the substrate, a slider, and a pressing part.

The slider includes a main body part, and a substrate receiver part. The main body part is housed inside the first housing space part and is reciprocatable between a first position and a second position. The main body part comprises a second housing space part that is provided in the main body part and houses the lead contact part of the contactor, and an opening that communicates with the second housing space part, and enable the substrate to be inserted therethrough. The substrate receiver part arranges the contactor between an inner surface of the second housing space part in the second housing space part and abuts against an end part of the substrate to position the substrate to a position where the lead contact part is connectable to the electrode pad. The substrate receiver part fixes the lead contact part to a position apart from the electrode pad of the substrate by coming into contact with the contactor in a state where the main body part is located at the first position or fixes to a position where a pressing force of the lead contact part against the electrode pad is limited to not greater than a predetermined value, and releases fixation of a position of the lead contact part when the main body part moves from the first position to the second position. The pressing part presses the contactor toward the electrode pad when the main body part moves from the first position to the second position.

Effect of the Invention

According to the present invention, a plug connector capable of improving the efficiency of attaching work of the substrates and improved yield can be provided.

BEST MODE FOR CARRYING OUT THE INVENTION

Figure 1:
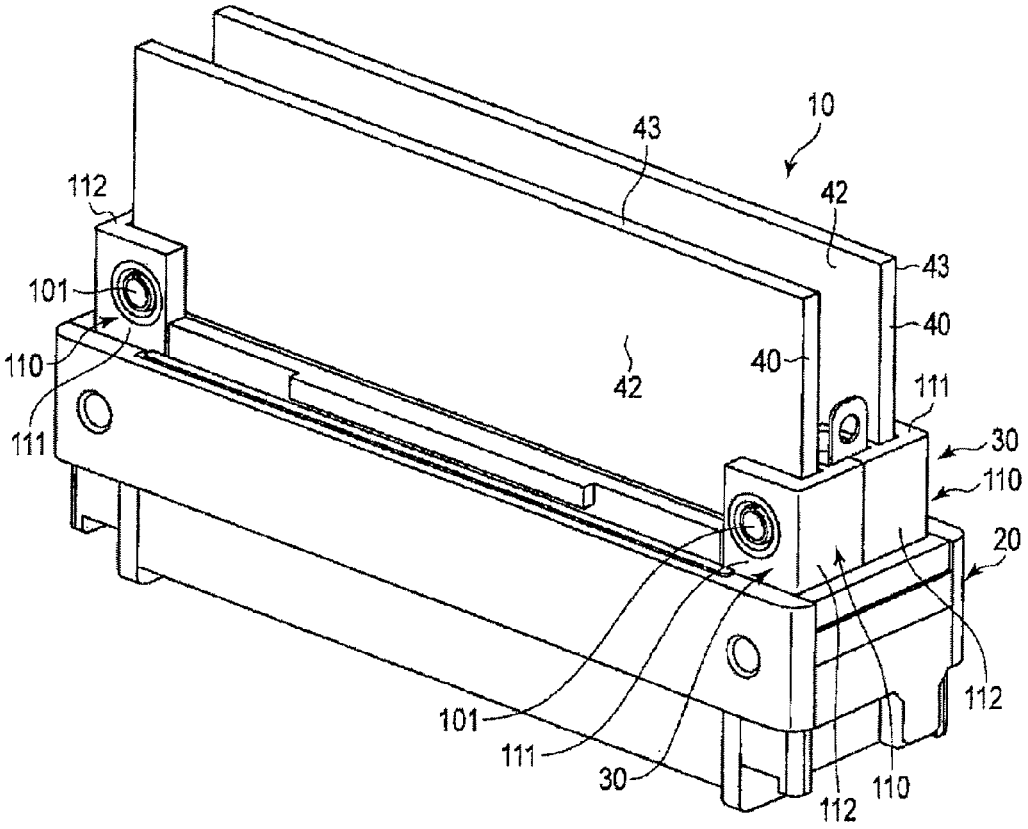
FIG. 1 is a perspective view illustrating a plug connector according to an embodiment of the present invention.

A plug connector according to an embodiment of the present invention will be described with reference to FIGS. 1 to 6. FIG. 1 is a perspective view illustrating a plug connector 10. The plug connector 10 is used, for example, for connecting electronic devices to each other. More specifically, the plug connector. 10 is provided on one electronic device, and is formed attachably and detachably to and from a receptacle connector provided in the other electronic device.

Figure 2:
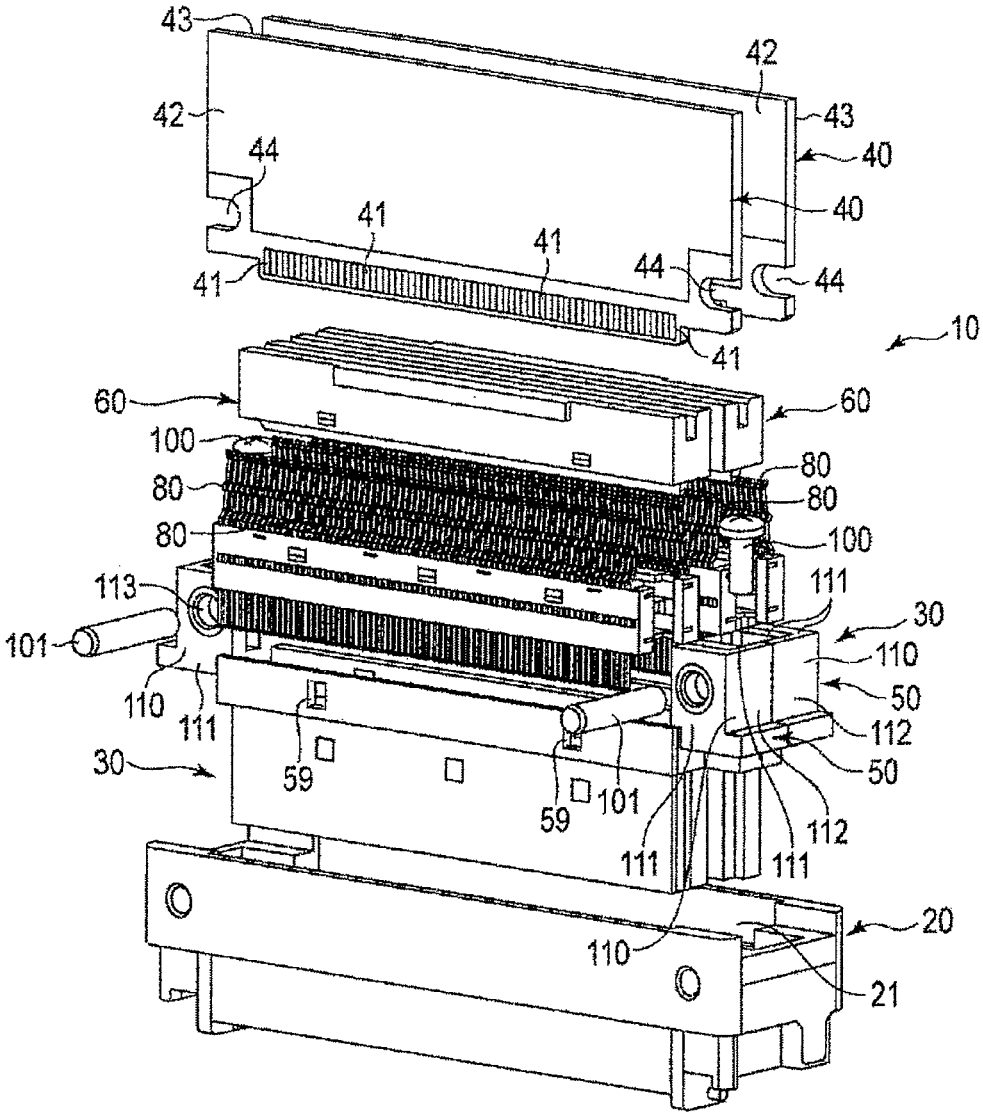
FIG. 2 is an exploded perspective view illustrating a state where the plug connector is disassembled.

FIG. 2 is an exploded perspective view illustrating a state where the plug connector 10 is disassembled. As illustrated in FIG. 1 and FIG. 2, the plug connector 10 includes a housing shell 20, and a pair of sub-assemblies 30 housed inside the housing shell 20. The sub-assemblies 30 each have the similar structure. For this reason, description will be given using the same reference numerals designated to both sub-assemblies.

The sub-assembly 30 has a substrate 40 provided with a plurality of electrode pads 41, an insulator 50 capable of housing the substrate 40, a plurality of contactors 80 provided inside the insulator 50 and electrically connected to the electrode pads 41 of the substrate 40, and a slider 60 housed inside the insulator 50 and slidably formed relative to the insulator 50.

A plurality of electrode pads 41 is provided at edge parts along a longitudinal direction of both principal surfaces 42, 43 of the substrate 40. The electrode pads 41 are arranged in a row along the longitudinal direction of the substrate 40. The substrate 40 is formed to be connectable to the one electronic device described above.

Figure 3:
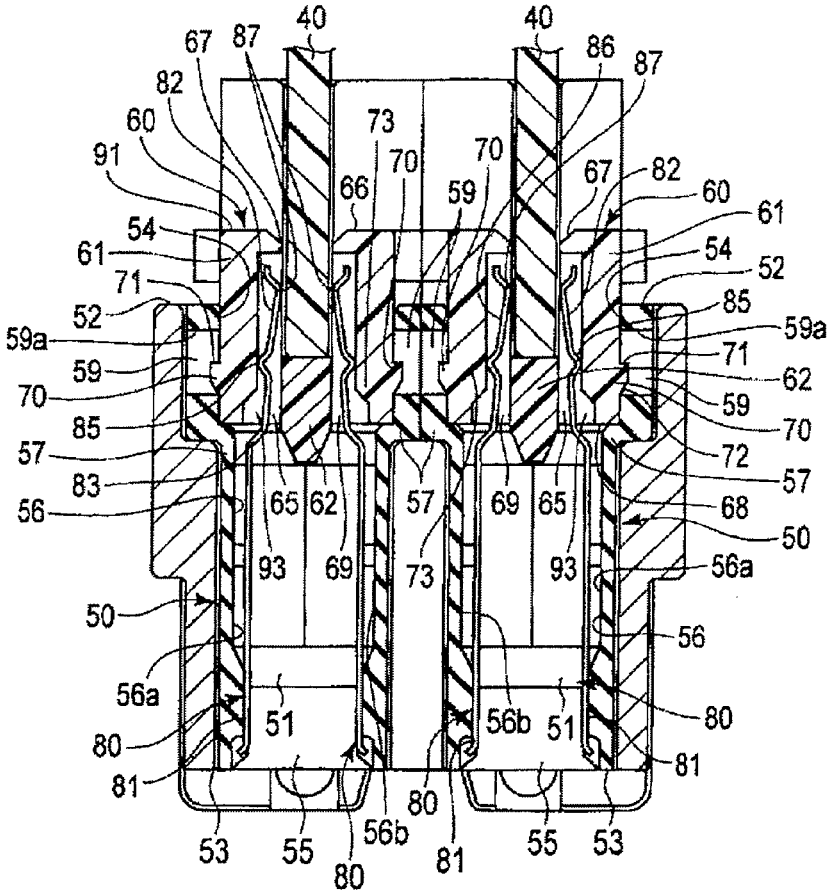
FIG. 3 is a cross-sectional view illustrating the plug connector along a cross-section orthogonal to a longitudinal direction.

FIG. 3 is a cross-sectional view illustrating the plug connector 10 along a cross-section orthogonal to a longitudinal direction thereof. As illustrated in FIG. 3, the insulator 50 is formed of an insulating member. The insulator 50 is formed so as to enable the slider 60 to be housed therein and to be slidable. Specifically, as illustrated in FIG. 3, a housing space part (first housing space part) 51 that can house the slider 60 is formed inside the insulator 50. On both end faces 52, 53 of the insulator 50, openings 54, 55 communicated with the housing space part 51 are formed.

In a range from a position in the vicinity of the opening 54 to the opening 55 in surface parts 56*a*, 56*b* along a longitudinal direction out of an inner surface 56 of the housing space part 51, a step part (fourth abutting part) 57 is formed. The step part 57 protrudes toward an inner side of the housing space part 51, with respect to a range of the step part 57 from the opening 54.

A width from the opening 54 to the step part 57 in the housing space part 51, that is, a width between the inner surfaces 56 of the housing space part 51 is set such that the slider 60 can be housed. A width between the step parts 57 is set narrower than a width of the slider 60.

The slider 60 is housed movably in a range from the opening 54 of the housing space part 51 of the insulator 50 to the step part 57. The slider 60 includes a main body part 61 formed, for example, in a rectangular shape, and a substrate receiver part 62 formed inside the main body part 61.

The main body part 61 is housed slidably in a range from the opening 54 of the housing space part 51 of the insulator 50 to the step part 57. More specifically, the main body part 61 is formed, so as to be slidable, such that a width is the same as a length across a range from the opening 54 to the step part 57 in the surface parts 56*a*, 56*b*, or is slightly smaller than a length across a range from the opening 54 to the step part 57 in the surface parts 56*a*, 56*b*. Both side surfaces opposed to the surface parts 56*a*, 56*b* of the housing space part 51 in the main body part 61 are formed parallel to the surface parts 56*a*, 56*b* of the housing space part 51.

In a section from the opening 54 to the step part 57 out of a wall part along a longitudinal direction of the insulator 50, there is formed an engaging hole part 59 that communicates the outside with the housing space part 51. In the present embodiment, as an example, the engaging hole part 59 is formed on the wall part on both sides so as to sandwich the housing space part 51. Further, as illustrated in FIG. 2, in the present embodiment, each of the engaging hole parts 59 is formed on each end part along the longitudinal direction of the insulator 50.

As illustrated in FIG. 3, on both sides of the main body part 61 of the slider 60, there is formed an engaging protruded part (regulating part, first abutting part) 70 that protrudes toward the outside in a width direction. The engaging protruded part 70 is formed to be housable in the engaging hole part 59 of the insulator 50.

The engaging hole part 59 is formed longer than the engaging protruded part 70 along a slide direction of the slider 60 relative to the insulator 50. The inner surface (regulating part, second abutting part) 59*a* of the opening 54 side of the engaging hole part 59 is a plane orthogonal to a moving direction of the slider 60 relative to the insulator 50. An end face 71 opposed in the slide direction to the inner surface 59*a* of the engaging hole part 59 in the engaging protruded part 70 is a plane orthogonal to the slide direction.

An opposite-side end face 72 of the end face 71 of the engaging protruded part 70 is inclined relative to the slide direction relative to the insulator 50 of the slider 60. This is for the purpose of making the insertion work to be performed easily, when the slider 60 is inserted through the opening 54 into the housing space part 51 of the insulator 50, from a state where the slider 60 is disassembled with respect to the insulator 50.

In other words, when the slider 60 is inserted into the housing space part 51 through the opening 54, the end face 72 of the engaging protruded part 70 abuts against edge part of the opening 54 of the insulator 50. However, the end face 72 is inclined, whereby the slider 60 can be inserted smoothly into the housing space part 51.

The slider 60 becomes slidable between a first position 90 (illustrated in FIG. 4 described below) where the end face 71 of the engaging protruded part 70 abuts against the inner surface 59*a* of the engaging hole part 59, and a second position 91 where the slider 60 abuts against the step part 57 of the insulator 50.

The housing space part (second housing space part) 65 is formed in the main body part 61 of the slider 60. In a circumferential surface of the main body part 61, an opening 67 that communicates with the housing space part 65 is formed on one end face 66 orthogonal to the slide direction of the main body part 61 relative to the insulator 50. The opening 69 that communicates with the housing space part 65 is formed on an end face (third abutting part) 68 on the opposite side to the end face 66 across the housing space part 65 in the main body part 61.

The end face 68 of the main body part 61 is formed abuttably against the step part 57 of the insulator 50. A position where the end face 68 abuts against the step part 57 is the second position 91. The main body part 61 has a height enough to allow it to extend to the outside through the opening 54 of the insulator 50, in a state where the end face 68 abuts against the step part 57 of the insulator 50.

The substrate receiver part 62 is housed inside the housing space part 65 of the main body part 61, and is formed slidably relative to the insulator 50 integral with the main body part 61. Specifically, the substrate receiver part 62 is fixed at both ends in the longitudinal direction of the main body part 61. The substrate receiver part 62 is arranged to have a clearance 93 between both inner surfaces along the longitudinal direction of the housing space part 65.

As illustrated in FIG. 2, a number of the contactors 80 equal to that of the electrode pads 41 provided on one of the substrates 40 are provided in the housing space part 51 of the insulator 50. More specifically, in the housing space part 51 of the insulator 50, a number of the contactors 80 equal to that of the electrode pads 41 provided on one principal surface 42 are provided, on a portion opposed to one principal surface 42 of the substrate 40, that is, a portion along the longitudinal direction of the housing space part 51. These contactors 80 are arranged spaced apart from one another in a pitch equal to a pitch between the electrode pads 41. These contactors 80 are arranged connectably to the corresponding electrode pads 41.

Similarly, in the other portion along the longitudinal direction of the housing space part 51, there are provided a number of the contactors 80 equal to that of the electrode pads 41 provided on the other principal surface 43 of the substrate 40. The contactor 80 provided on the one portion along the longitudinal direction of the housing space part 51, and the contactor 80 provided on the other portion along the longitudinal direction of the housing space part 51 are provided symmetrically across the substrate receiver part 62. In order to improve conductivity, plating processing is carried out on the surfaces of the respective contactors 80 using a metal having a high conductivity.

As illustrated in FIG. 3, the contactor 80 has a length extending from one end to the other end in a height direction of the insulator 50, in other words, a length extending from the opening 55 to the opening 54. The one end part 81 of the contactor 80 is fixed in the vicinity of the opening 55 of the insulator 50. The one end part 81 of the contactor 80, when connected to the receptacle connector described above, is electrically connected to the contactor of the receptacle connector.

In the contactor 80, a section from the one end part 81 to the step part 57 is formed parallel to the inner surfaces of the housing space part 51 of the insulator 50. The other end part 82 of the contactor 80 is housed within the housing space part 65 of the slider 60 through the opening 64 of the slider 60. More specifically, the other end part 82 of the contactor 80 is housed inside the clearance 93 defined between the inner surface of the housing space part 65 of the slider 60 and the substrate receiver part 62.

The other end part 82 of the contactors 80 includes a bending part 83 that bends the contactors 80 toward the substrate receiver part 62 side, a protruding part 85 that protrudes toward the inner surface of the housing space part 65 of the slider 60, a slope 86 inclined toward a width direction inner side of the housing space part 65 of the slider 60, and a lead contact part 87 formed connectably to the electrode pads 41 of the substrate 40.

The bending part 83 is opposed in the width direction to the step part 57 of the insulator 50. The bending part 83 is bent in the width direction inner side of the housing space part 65, relative to the section from the one end part 81 to the bending part 83 in the contactor 80.

The protruding part 85 is formed by curving the contactor 80. The protruding part 85 protrudes toward the inner surface of the housing space part 65 of the slider 60.

The inner surface of the housing space part 65 of the slider 60, and the protruding part 85 will be specifically described. In the section along the longitudinal direction in the inner surface of the housing space part 65 of the slider 60, the step part (pressing part) 73 is formed, in a range from a position in the vicinity of the opening 69 to the opening 69. The step part 73 protrudes toward the width direction inner side of the housing space part 65. The inner surface 74 of the step part 73 is parallel to the slide direction of the slider 60 relative to the insulator 50.

Figure 4:
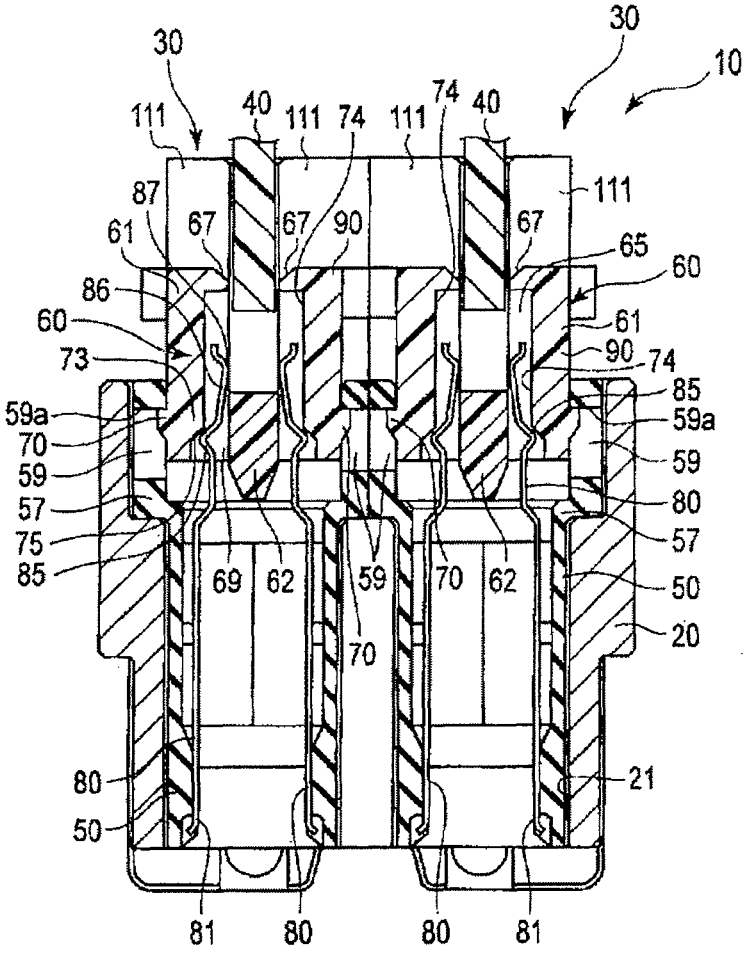
FIG. 4 is a cross-sectional view illustrating, similar to FIG. 3, a state where each of sliders of the plug connector is located at a first position, and each of substrates of the plug connector is apart from a substrate receiver part of the plug connector.

FIG. 4 is a cross-sectional view illustrating, similar to FIG. 3, a state where the slider 60 is located at the first position 90, and the substrate 40 is apart from the substrate receiver part 62. As illustrated in FIG. 4, the step part 73 is formed at a position where the step part 73 does not abut against the protruding part 85, in a state where the slider 60 is located at the first position 90. On the opening 69 side in the step part 73, the inclined plane 75 is formed. The inclined plane 75 is inclined to the slide direction of the slider 60 relative to the insulator 50, and formed so that the protruding part 85 can ride thereon, when the slider 60 moves from the first position 90 to the second position 91.

Returning to the description of the contactor 80, the slope part 86 of the contactor 80 is formed continuous to the protruding part 85. The lead contact part 87 is formed continuous to the slope part 86. The slope part 86 is inclined to the slide direction of the slider 60 relative to the insulator 50. Therefore, the lead contact part 87 is arranged on the width direction inner side of the housing space part 65, relative to the protruding part 85.

The slope part 86 will be specifically described. As illustrated in FIG. 4, the slope part 86 abuts against the substrate receiver part 62, in a state where the slider 60 is located at the first position 90. The substrate receiver part 62 is formed by abutting against the slope part 86, so that the position of the lead contact part 87 can be fixed, that is, can be positioned, at a position apart from the trajectory of the substrate 40.

The trajectory of the substrate 40 is a path along which the substrate 40 moves until the substrate 40 abuts against the substrate receiver part 62, in a range from the opening 67 of the slider 60 to the substrate receiver part 62. The position of the lead contact part 87 is fixed at a position apart from the trajectory of the substrate 40, whereby the inserted tip end and the electrode pad 41 of the substrate 40 do not come into contact with the lead contact part 87 of the contactor 80, even when the substrate 40 is housed into the slider 60 through the opening 67, in a state where the slider 60 is located at the first position 90.

Alternatively, the substrate receiver part 62 comes into contact with the slope part 86, in a state where the slider 60 is located at the first position 90, whereby the lead contact part 87 may be fixed, that is, positioned at a position where a pressing force applied from the lead contact part 87 to the substrate 40 is within a predetermined value.

This point will be described more specifically. By positioning the lead contact part 87 at the position where it comes into contact with the substrate 40, the lead contact part 87 comes into contact with a tip end of the substrate 40 when the substrate 40 is inserted into the slider 60, and rides on the tip end.

The lead contact part 87 rides on the tip end of the substrate 40, whereby the contactor 80 is deflected. As a result, the lead contact part 87 is pressed against the tip end of the substrate 40 by an elastic force of the contactor 80. The pressing force becomes large in direct proportional to an amount of deflection of the contactor 80.

The above-described predetermined value is a maximum value of a range within which plating on the surface of the lead contact part 87 is not peeled. In other words, if the predetermined value is exceeded, the plating will be peeled. The predetermined value can be obtained by experiment or the like.

A housing shell 20 is formed to be capable of housing two sub-assemblies 30. Specifically, inside the housing shell 20, a housing space part 21 is formed. The housing space part 21 is formed to be capable of housing and fixing two sub-assemblies 30 coupled in the width direction.

As illustrated in FIG. 2, specifically, the insulators 50 are fixed to the housing shells 20, for example, by screws 100.

At longitudinal both end parts of each insulator 50, there are formed enclosure parts 110 that cover longitudinal both end parts of the substrate 40. The shapes of the respective enclosure parts 110 are the same. The enclosure part 110 is in a planar shape, which is C-shaped and opened to one side, and has a pair of side walls 111, and an end wall 112 that connects both side walls 111. The pair of side walls 111 and the end wall 112 are formed such that the longitudinal end part of the substrate 40 can be fitted thereon, in a range enclosed by these both side walls 111 and the end wall 112.

On the both side walls 111, engaging hole parts (fixing structures, first engaging parts) 113 that penetrate the both side walls 111 in the width direction are formed. In a state where the substrate 40 abuts against the substrate receiver part 62, and the slider 60 is located at the second position 91, engaging groove parts 44 (fixing structures, second engaging parts) that penetrate the substrates 40 in the width direction are formed at portions opposed in the width direction to the both side walls 111 of the enclosure parts 111 in the substrate 40.

The engaging hole parts 113, and the engaging groove parts 44 are formed such that spring pins (fixing structure, insertion members) 101 can be inserted, and engaged. When the spring pins 101 are inserted into the engaging hole parts 113 and the engaging groove parts 44, they are fitted to the engaging hole parts 113 and the engaging groove parts 44. The spring pin 101 has a length reaching the engaging hole part 113 of the other side wall 111 from the engaging hole part 113 of the one side wall 111.

Next, work for connecting the electrode pads 41 of the substrate 40 and the lead contact parts 87 of the contactors 80 will be described. First, the slider 60 is moved to the first position 90. When the slider 60 is moved to the first position 90, the engaging protruded part 70 of the slider 60 abuts against the inner surface 59*a* of the engaging hole part 59, whereby movement of the slider 60 is stopped. A worker moves the slider 60 to a position where movement of the slider 60 relative to the insulator 50 is stopped, and whereby the slider 60 can be moved to the first position 90.

Figure 5:
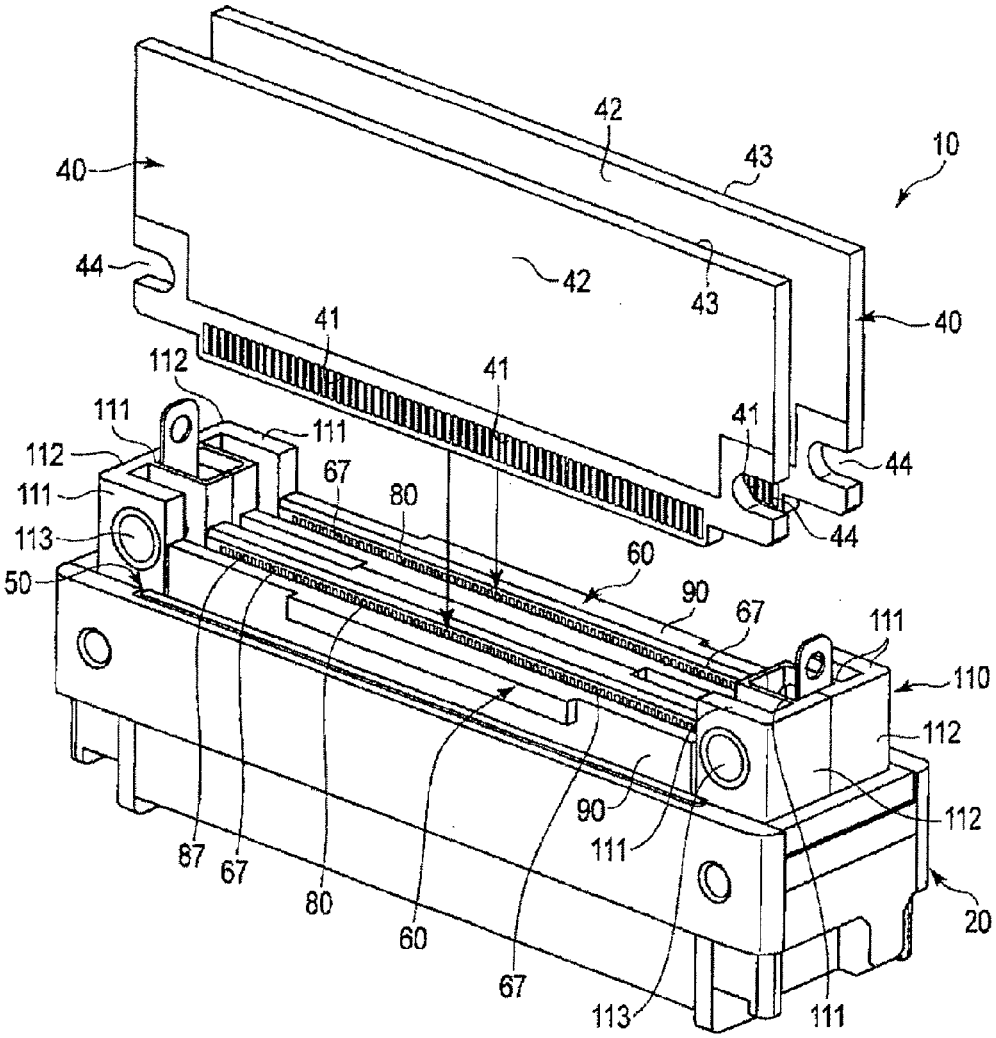
FIG. 5 is a perspective view illustrating a state where each of the substrates is arranged opposed to an opening of each of the sliders.

FIG. 5 is a perspective view illustrating a state where the substrates 40 are arranged opposed to the openings 67 of the sliders 60. Next, as illustrated in FIG. 5, the substrates 40 are opposed to the openings 67 of the sliders 60, in a posture of end parts on the side, where the electrode pads 41 are formed, facing toward the openings 67. Next, as illustrated in FIG. 3, each of the substrates 40 is inserted from the opening 67 of the slider 60.

Figure 6:
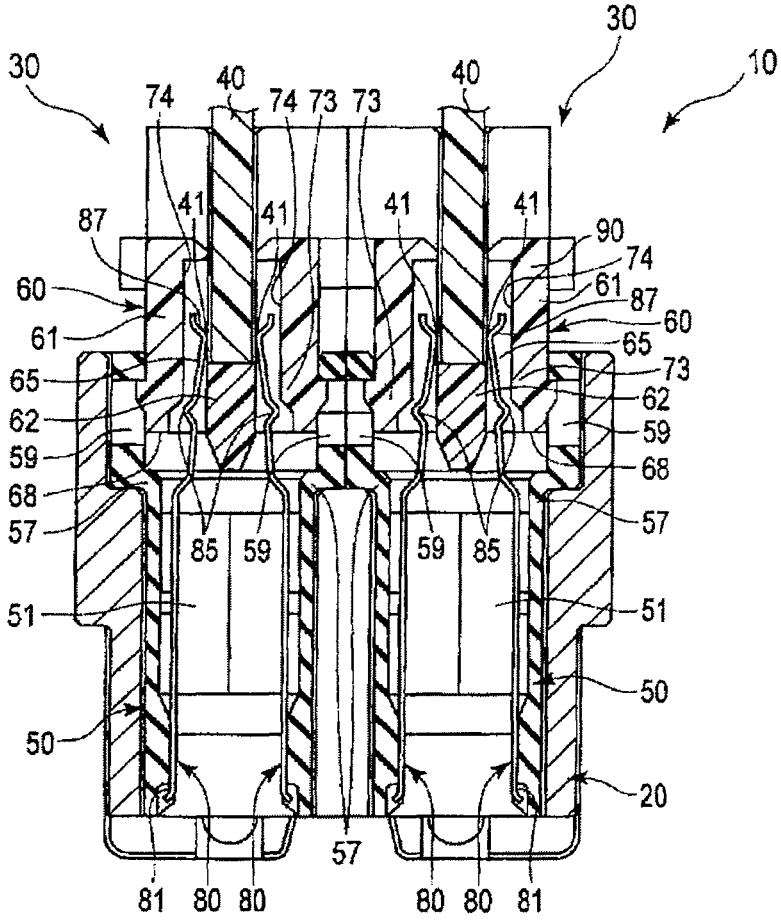
FIG. 6 is a cross-sectional view illustrating, similar to FIG. 3, a state where each of the substrates is inserted into a housing space part of each of the sliders to a position where each of the substrates abuts against the substrate receiver part.

FIG. 6 is a cross-sectional view illustrating, similar to FIG. 3, a state where each of the substrates 40 is inserted into the housing space part 65 of the slider 60 up to a position where the substrate 40 abuts against the substrate receiver part 62. Next, as illustrated in FIG. 6, each of the substrates 40 is inserted into the housing space part 65 through the opening 67 of the slider 60. When the worker inserts the substrate 40 to the position where the substrate 40 abuts against the substrate receiver part 62, the worker stops the insertion work.

In the state where the slider 60 is located at the first position 90, the contactor 80 is positioned at the position apart from the trajectory of the substrate 40 by the substrate 40 abutting against the substrate receiver part 62. In other words, even when the substrate 40 abuts against the substrate receiver part 62, the contactor 80 does not come into contact with the substrate 40.

Alternatively, in the state where the slider 60 is located at the first position 90, by the substrate 40 abutting against the substrate receiver part 62, the contactor 80 is positioned at a position where the pressing force against the substrate 40 becomes not greater than the predetermined value where the plating on the surface of the contactor 80 is not peeled.

For this reason, when inserting the substrate 40 until abutting against the substrate receiver part 62, the plating on the surface of the contactor 80 is prevented from being peeled even when the contactor 80 comes into contact with the tip end of the substrate 40. Since the pressing force is a force of the degree to which the plating on the contactor 80 is not peeled, the substrate 40 can be inserted with a smaller force until the substrate 40 abuts against the substrate receiver part 62.

Next, as illustrated in FIG. 3, while maintaining the state where the substrate 40 abuts against the substrate receiver part 62, the slider 60 is moved from the first position 90 to the second position 91. The position where the substrate receiver part 62 is abutted thereagainst in the slope part 86 of the contactor 80 is moved, by the slider 60 moving from the first position 90 to the second position 91.

By movement of the position where the substrate receiver part 62 abuts at the slope part 86 of the contactor 80, regulation of the position of the lead contact part 87 of the contactor 80 by the substrate receiver part 62, in other words, positioning of the lead contact part 87 of the contactor 80 to a position deviated from the trajectory of the substrate 40, or positioning of the lead contact part 87 of the contactor 80 to a position where the pressing force applied from the lead contact part 87 of the contactor 80 to the substrate 40 becomes not greater than the predetermined value is released. This is because the slope part 86 is inclined in the slide direction of the slider 60.

For this reason, the contactor 80 becomes movable to the substrate 40 side, and the lead contact part 87 comes into contact with the electrode pads 41 of the substrate 40. In this manner, the substrate receiver part 62 has a function of positioning the substrate 40 to a position where the lead contact part 87 is connectable to the electrode pads 41.

Further, by the slider 60 moving from the first position 90 to the second position 91, the inclined plane 75 of the tip end of the step part 73 of the slider 60 abuts against the protruding part 85 of the contactor 80. When the slider 60 is further moved, the protruding part 85 rides on the step part 73.

By the protruding part 85 riding on the step part 73, the protruding part 85 is pressed toward the substrate 40. Accordingly, the pressing force applied from the lead contact part 87 to the electrode pad 41 is increased.

The shape of the protruding part 85 and shape of the step part 73 are formed, so that sufficient connection strength between the lead contact part 87 and the electrode pad 41 can be obtained by the pressing force applied from the lead contact part 87 to the electrode pad 41, generated when the protruding part 85 rides on the step part 73.

When the slider 60 reaches the second position 91, by the tip end face 68 of the slider 60 abutting against the step part 57 of the insulator 50, movement of the slider 60 is stopped. The worker can move the slider 60 to the second position 91, by inserting the substrate 40 and the slider 60 into the insulator 50 until the movement of the slider 60 is stopped.

When the slider 60 reaches the second position 91, the engaging hole part 113 of the insulator 50 and the engaging groove part 44 of the substrate 40 are opposed to each other in the width direction. The worker inserts the spring pin 101 into the engaging hole part 113 and the engaging groove part 44, when the slider 60 reaches the second position 91. By inserting the spring pin 101 into the engaging hole part 113 and the engaging groove part 44, the substrate 40 is fixed in the slider 60 by the spring pin 101. Since the substrate 40 abuts against the substrate receiver part 62, the slider 60 is fixed to the second position 91.

When the substrate 40 is pulled from inside the slider 60, first, the spring pin 101 is pulled from the engaging hole part 113 and the engaging groove part 44.

Next, the slider 60 is moved from the second position 91 to the first position 90. When the slider 60 is moved to the first position 90, the substrate 40 is also moved by the substrate receiver part 62. When the slider 60 is moved to the first position 90, the lead contact part 87 of the contactor 80 is separated from the electrode pad 41 of the substrate 40, by the substrate receiver part 62 abutting against the contactor 80. Alternatively, the lead contact part 87 is moved to the position where the pressing force to be applied to the electrode pad 41 becomes the predetermined value. The worker pulls out the substrate 40, after the slider 60 has been moved to the first position 90.

In the plug connector 10 configured in this manner, the efficiency of attaching work of the substrates 40 can be improved, and the yield can be improved. This point will be specifically described. Since the substrate 40 is inserted in the state where the slider 60 is located at the first position 90, the insertion work of the substrate 40 can be simply performed.

As described specifically, in the state where the slider 60 is located at the first position 90, the lead contact part 87 of the contactor 80 does not come into contact with the substrate 40. Alternatively, even when the contactor 80 comes into contact with the substrate 40, the pressing force applied from the contactor 80 to the substrate 40 is a value where plating on the surface of the contactor 80 is never peeled, and it is relatively small. For this reason, the substrate 40 can be simply inserted into the position where the substrate 40 abuts against the substrate receiver part 62.

Furthermore, when the slider 60 is moved from the first position 90 to the second position 91, in the state where the substrate 40 abuts against the substrate receiver part 62, the contactor 80 is deformed, by the step part 73 of the slider 60 that presses the protruding part 85 of the contactor 80, and thus the pressing force applied from the lead contact part 87 to the electrode pad 41 becomes large.

The step part 73 of the slider 60 and the protruding part 85 of the contactor 80 are formed so that the lead contact part 87 and the electrode pad 41 are electrically connected, and sufficient pressing force enough to maintain connection state is generated. In other words, the step part 73 of the slider 60 and the protruding part 85 of the contactor 80 are formed so that electrical connection between the lead contact part 87 and the electrode pad 41 and maintenance of the connection have a high reliability.

By a simple work in this manner to move the slider 60 from the first position 90 to the second position 91, electrical connection having a high reliability between the lead contact part 87 of the contactor 80 and the electrode pad 41 of the substrate 40 can be obtained.

The substrate 40 in this manner can be simply inserted to the position where the substrate 40 comes into contact with the substrate receiver part 62, and electrical connection having a high reliability between the lead contact part 87 of the contactor 80 and the electrode pad 41 can be simply obtained, and as a result, the efficiency of attaching work of the substrate 40 can be improved.

Furthermore, connection between the lead contact part 87 of the contactor 80 and the electrode pad 41 of the substrate 40 is maintained by the pressing force applied from the lead contact part 87 to the electrode pad 41. Since soldering is never used in work for connecting the lead contact part 87 and the electrode pad 41, failure of the work does not occur. Consequently, the yield can be improved.

The plug connector 10 of the present embodiment in this manner is capable of improving the efficiency of attaching work of the substrates, and improving the yield.

Further, by the engaging protruded part 70 of the slider 60 abutting against the inner surface 59*a* of the engaging hole part 59 of the insulator 50, when the slider 60 is moved to the first position 90, movement of the slider 60 is stopped. By the tip end face 68 of the slider 60 abutting against the step part 57 of the insulator 50, when the slider 60 is moved to the second position 91, movement of the slider 60 is stopped.

The slider 60 in this manner can be moved to the positions 90, 91, by moving the slider 60 until stopped, and thus the worker needs not to perform detailed alignment of the slider 60, the efficiency of the attaching work of the substrate 40 can be improved.

Further, a structure for stopping the slider 60 at the positions 90, 91 is configured by the engaging protruded part 70 formed in the slider 60, and the engaging hole part 59 formed in the insulator 50. As a result, a structure for stopping the slider 60 at the positions 90, 91 can be simply configured.

Then, retention of the substrates 40 can be performed by inserting the spring pin 101 into the engaging hole part 113 and the engaging groove part 44.

Alternatively, the retention structure of the substrates 40 can be simply configured, by configuring the retention structure of the substrate 40 by the spring pin 101, the engaging hole part 113 formed on the insulator 50, and the engaging groove part 44 formed on the substrate 40.

This invention is not intended to be limited to the above-described exemplary embodiment as it is, and it can be embodied by modifying components within a range not departing from the spirit in an implementation stage. In addition, various inventions can be formed by an appropriate combination of a plurality of components disclosed in the above-described exemplary embodiment. For example, several components may be deleted out of all components illustrated in the above-described exemplary embodiment.

REFERENCE NUMBER

10: Plug connector
40: Substrate

41: Electrode pad
44: Engaging groove part (fixing structure, second engaging part)
50: Insulator
51: Housing space part (first housing space part)
57: Step part (fourth abutting part)
59*a*: Inner surface (regulating part, second abutting part)
60: Slider
61: Main body part
62: Substrate receiver part
65: Housing space part (second housing space part)
67: Opening
68: End face (third abutting part)
70: Engaging protruded part (regulating part, first abutting part)
73: Step part (pressing part)
80: Contactors
87: Lead contact part
90: First position
91: Second position
101: Spring pin (fixing structure, inserted member)
113: Engaging hole part (fixing structure, first engaging part)

What is claimed is:

1. A plug connector, comprising:

a substrate having an electrode pad;

an insulator having a first housing space part;

a contactor including a lead contact part connectable to the electrode pad of the substrate;

a slider including a main body part and a substrate receiver part;

the main body part housed inside the first housing space part and reciprocatable between a first position and a second position, the main body part having an interior sidewall defining a second housing space part that houses the lead contact part of the contactor, the main body part further having an opening that communicates with the second housing space part and that enables the substrate to be inserted therethrough;

the substrate receiver part configured to arrange the contactor between an inner surface of the second housing space part and to abut against an end part of the substrate to position the substrate such that the lead contact part is connectable to the electrode pad, the substrate receiver part (a) configured to fix the lead contact part (i) in a position contacting the electrode pad of the substrate in a configuration in which the main body part is located at the first position or (ii) in a position in which a pressing force of the lead contact part on the electrode pad is limited to not greater than a predetermined value, and (b) configured to release fixation of the position of the lead contact part when the main body part is moved from the first position to the second position; and a stepped surface formed along the interior sidewall of the main body part, the stepped surface including a first portion and a second portion having a smaller interior dimension than the first portion, the stepped surface configured to press the contactor toward the electrode pad when the main body part is moved from the first position to the second position.

2. The plug connector according to claim 1, further comprising a regulating part for regulating movement of the slider relative to the insulator to between the first position and the second position.

3. The plug connector according to claim 2, wherein the regulating part includes, a first abutting part provided in the slider;

a second abutting part for abutting against the first abutting part in a direction toward the second position from the first position in a configuration in which the slider main body part is located at the first position;

a third abutting part provided in the slider; and a fourth abutting part for abutting against the third abutting part in a direction toward the first position from the second position in a configuration in which the slider main body part is located at the second position.

4. The plug connector according to claim 1, further comprising a fixing structure for fixing the substrate to the inside of the second housing space part of the slider.

5. The plug connector according to claim 4, wherein the fixing structure includes, a first engaging part in the insulator;

a second engaging part in the substrate; and an insertion member inserted into and engaged with the first engaging part and the second engaging part.

6. The plug connector according to claim 1, wherein the contactor includes a first fixed end that is fixed to the insulator, and a second free end that is freely positioned in the second housing space part.

7. The plug connector according to claim 6, wherein the contactor includes a protruding part, which is located between the first fixed end and the second free end, that is positioned to engage the second portion of the stepped surface in the first position of the main body part.

8. The plug connector according to claim 7, wherein the protruding part is located adjacent and spaced inwardly from the first portion of the stepped surface in the first position of the main body part.

* * * * *